US011828568B2

(12) United States Patent
Hardy et al.

(10) Patent No.: US 11,828,568 B2
(45) Date of Patent: Nov. 28, 2023

(54) FIREARM UTILITY CASE

(71) Applicants: Michael Hardy, Ward, AR (US); Farah Byers, Ward, AR (US)

(72) Inventors: Michael Hardy, Ward, AR (US); Farah Byers, Ward, AR (US)

( * ) Notice: Subject to any disclaimer, the term of this patent is extended or adjusted under 35 U.S.C. 154(b) by 0 days.

(21) Appl. No.: 16/992,417

(22) Filed: Aug. 13, 2020

(65) Prior Publication Data

US 2021/0063113 A1 Mar. 4, 2021

Related U.S. Application Data

(60) Provisional application No. 62/893,415, filed on Aug. 29, 2019.

(51) Int. Cl.
*F41C 33/06* (2006.01)

(52) U.S. Cl.
CPC ..... *F41C 33/06* (2013.01)

(58) Field of Classification Search
CPC ..... F41C 33/06
USPC ..... 224/607
See application file for complete search history.

(56) References Cited

U.S. PATENT DOCUMENTS 2,023,792 A * 12/1935 Sampson ..... A63B 55/40 206/315.4
4,182,391 A * 1/1980 Kjose ..... A63B 55/40 224/581
4,420,024 A * 12/1983 Clayton ..... A63B 60/64 206/315.4
4,793,532 A * 12/1988 Cash ..... A45C 7/0095 224/584
4,951,816 A * 8/1990 Smith ..... A45C 7/0063 190/103
5,007,250 A * 4/1991 Musielak ..... A45C 11/20 383/29
5,224,602 A * 7/1993 Bettles ..... A63B 71/0045 206/579
5,327,669 A * 7/1994 Lannan ..... A01K 97/08 206/315.11
6,009,995 A * 1/2000 Speck ..... A63B 60/60 206/315.9
6,119,388 A 9/2000 Jones et al.
6,561,329 B2 * 5/2003 Stobbs, II et al. . A63B 71/0045 190/112
6,595,358 B1 * 7/2003 Speck ..... A63B 60/60 206/315.9
6,626,339 B2 9/2003 Gates et al.
6,629,601 B1 * 10/2003 Russell ..... A63B 55/40 206/315.3
7,455,178 B2 * 11/2008 Miller, Jr. ..... A45C 11/00 190/125
7,559,423 B2 * 7/2009 Vosloo ..... A45C 11/00 206/315.1

(Continued)

*Primary Examiner* — Peter N Helvey
(74) *Attorney, Agent, or Firm* — Boudwin Intellectual Property Law, LLC; Daniel Boudwin

(57) ABSTRACT

A firearm utility case is provided. The firearm utility case includes a flexible body having a first end opposite a second end. A pair of pockets are disposed on the flexible body, each pocket having an open proximal end opposite a closed distal end, wherein the pair of pockets extend between the first end and the second end. The pair of pockets are disposed parallel to each other. A plurality of apertures are disposed along the first end.

1 Claim, 4 Drawing Sheets

(56) References Cited

U.S. PATENT DOCUMENTS

| | | | | |
|---|---|---|---|---|
| 7,819,248 | B1 * | 10/2010 | Takach | B25H 3/00 206/419 |
| 8,584,861 | B2 * | 11/2013 | Porath | B65D 85/70 206/756 |
| 2003/0089749 | A1 | 5/2003 | Valdez-Campbell | |
| 2008/0054032 | A1 | 3/2008 | Jones | |
| 2008/0231063 | A1 | 9/2008 | Bowers | |
| 2016/0095417 | A1 * | 4/2016 | Bruffey | A45C 13/30 224/645 |
| 2021/0063112 | A1 * | 3/2021 | Culton | F41C 33/06 |
| 2021/0093060 | A1 * | 4/2021 | Dooling | A45C 13/103 |

* cited by examiner

FIREARM UTILITY CASE

CROSS REFERENCE TO RELATED APPLICATIONS

This application claims the benefit of U.S. Provisional Application No. 62/893,415 filed on Aug. 29, 2019. The above identified patent application is herein incorporated by reference in its entirety to provide continuity of disclosure.

BACKGROUND OF THE INVENTION

The present invention relates to firearm cases. More particularly, the present invention pertains to firearm cases that can safely secure a pair of firearms therein that can be supported in a variety of positions during transport.

Many individuals enjoy hunting, target shooting, or other such activities, which require that the individual transport firearms from one location to another. Safely transporting firearms is essential to ensure the safety of people in the vicinity. Additionally, care when transporting firearms prevents damage to the firearms, which can be costly to repair. Jostling the firearms during transit can cause the sights or other attached optics to become misaligned, which can be frustrating to repeatedly calibrate. Typical vehicles lack a means for safely and securely transporting firearms, particularly for larger firearms such as rifles and shotguns. Often, an individual must transport such larger firearms in the trunk or storage compartment of a larger vehicle, which can prevent people with smaller vehicles from safely transporting firearms. Therefore, a device that allows a user to conveniently, safely, and securely transport firearms in a vehicle is desired.

In light of the devices disclosed in the known art, it is submitted that the present invention substantially diverges in design elements from the known art and consequently it is clear that there is a need in the art for an improvement to existing firearm cases. In this regard, the instant invention substantially fulfills these needs.

SUMMARY OF THE INVENTION

In view of the foregoing disadvantages inherent in the known types of firearm cases now present in the known art, the present invention provides a firearm utility case wherein the same can be utilized for providing convenience for the user when safely and securely transporting firearms in a vehicle.

The present system comprises a flexible body having a first end opposite a second end. A pair of pockets having an open proximal end and a closed distal end are disposed on the flexible body between the first end and the second end. The pair of pockets are disposed parallel to each other. A plurality of apertures are disposed along the first end. In some embodiments, a fastener is disposed on each of a first side and a second side of the flexible body. In other embodiments, the pair of pockets each comprise a first panel and a second panel, wherein the first and second panels are removably securable via complementary fasteners disposed thereon. In another embodiment, the plurality of apertures comprises a reinforcing member along a perimeter thereof. In other embodiments, a carrying strap is disposed on a first side of the flexible body. In yet another embodiment, a pair of support straps are disposed on the second side of the flexible body, wherein each support strap forms a loop. In some embodiments, each of the carrying strap and the pair of support straps may include a buckle thereon, the buckle configured to selectively adjust a length of each of the carrying strap and the pair of support straps, respectively. In another embodiment, a linear distance between the open proximal end and the first end is greater than a linear distance between the closed distal end and the second end.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
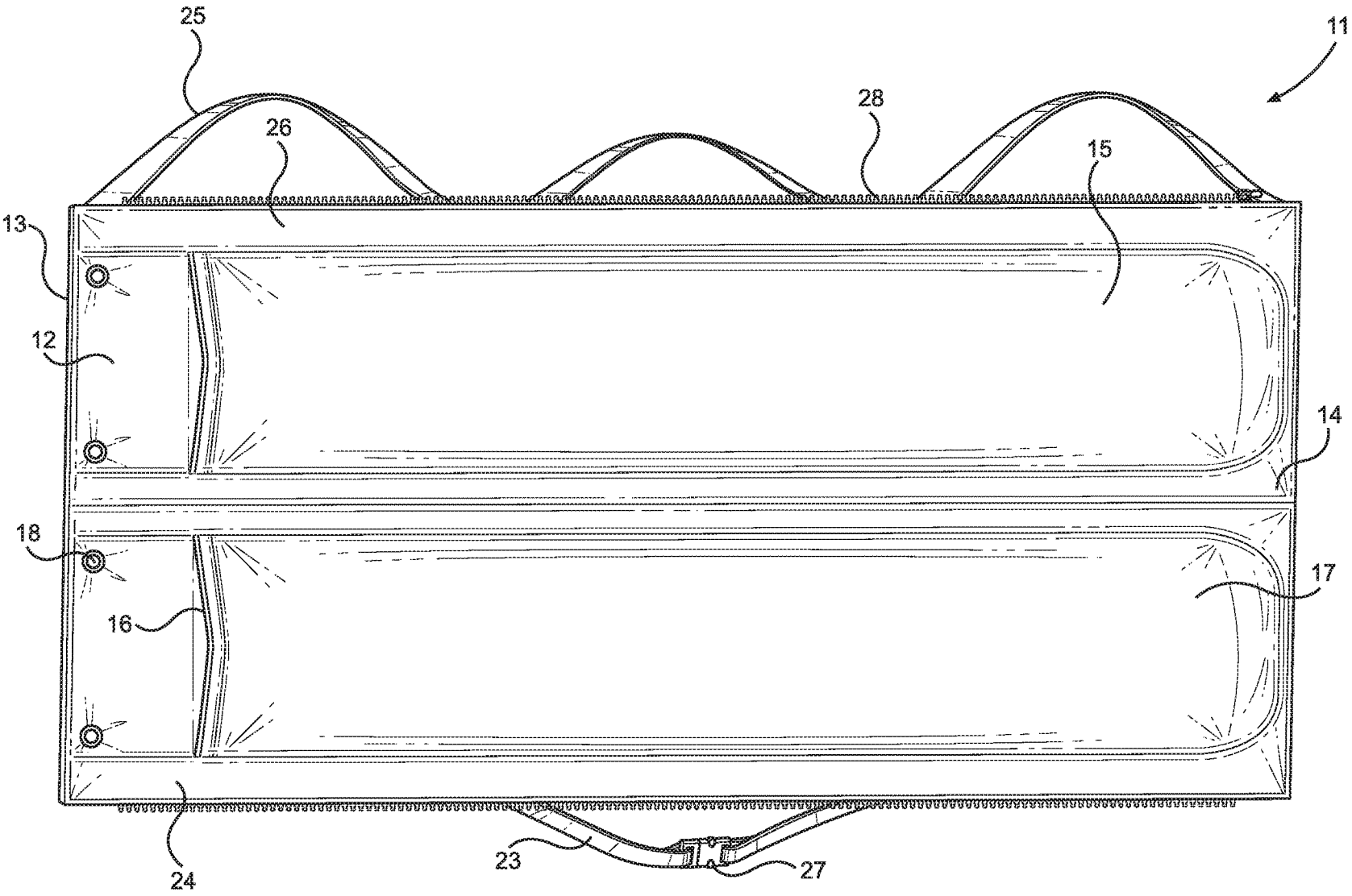
FIG. 1A shows a top down view of an embodiment of the firearm utility case in an open position.

Reference is made herein to the attached drawings. Like reference numerals are used throughout the drawings to depict like or similar elements of the firearm utility case. The figures are intended for representative purposes only and should not be considered to be limiting in any respect.

Figure 1B:
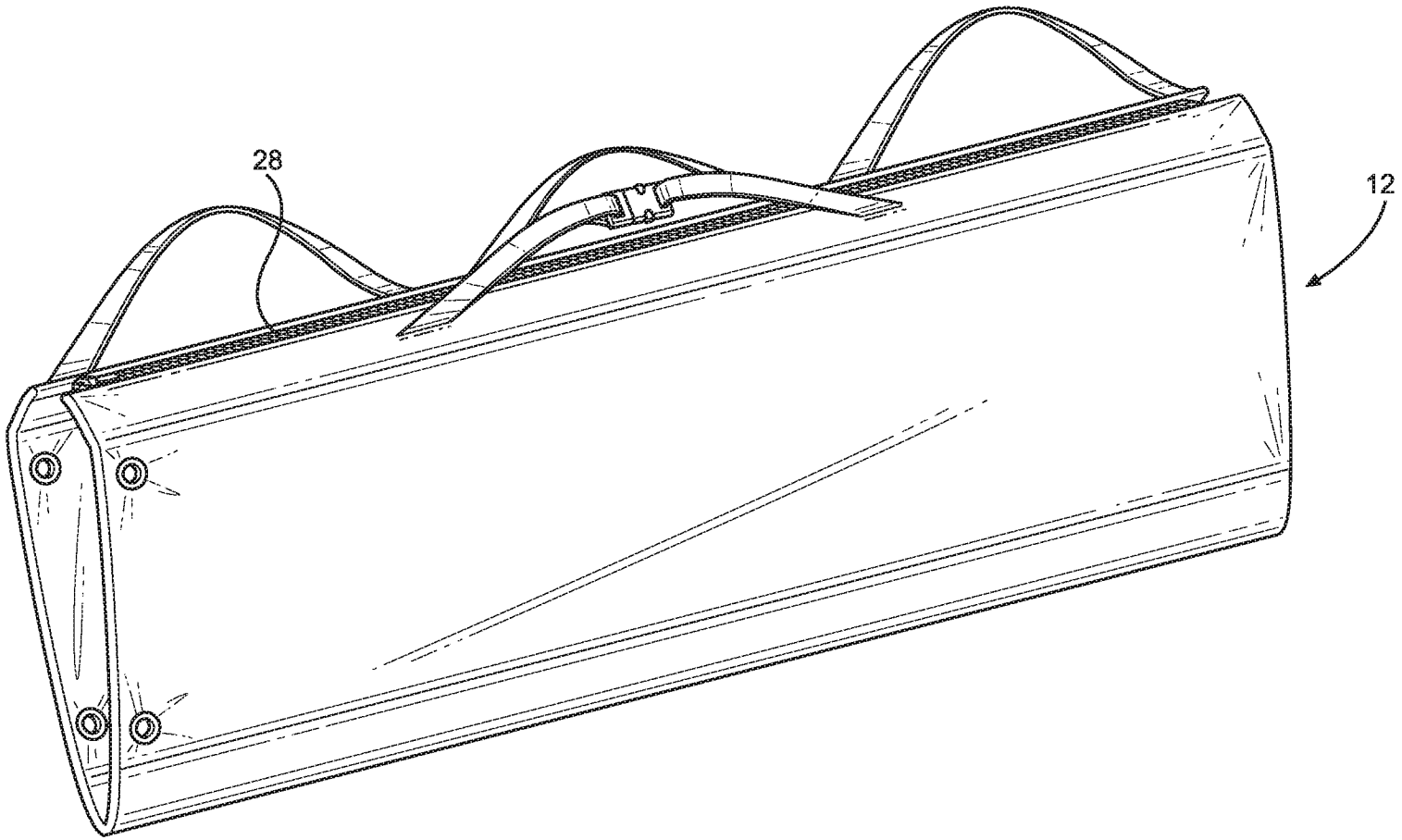
FIG. 1B shows a perspective view of an embodiment of the firearm utility case in a closed position.

Referring now to FIGS. 1A and 1B, there is shown a top down view of an embodiment of the firearm utility case in an open position and a perspective view of an embodiment of the firearm utility case in a closed position, respectively. The firearm utility case 11 comprises a flexible body 12 having a first end 13 opposite a second end 14. A pair of pockets 15 are disposed on the flexible body 12, such that the pair of pockets 15 extend between the first and second ends 13, 14. Each pocket of the pair of pockets 15 comprises an open proximal end 16 and a closed distal end 17, such that the open proximal end 16 provides access to an interior volume of the pocket. The flexible body 12 can further comprise padding therein in order to maximize protection of items, such as rifles, shotguns, or other firearms stored within the pair of pockets 15.

In the illustrated embodiment, the pair of pockets 15 are disposed parallel to each other along the flexible body 12, such that a pair of firearms can be stored therein. In the shown embodiment, a linear distance between the first end 13 and the open proximal end 16 of each of the pair of pockets 15 is greater than a linear distance between the closed distal end 17 and the second end 14. This allows a firearm stored within the pair of pockets 15 to be protected by the flexible body 12 in the event of partial removal from the pair of pockets 15, such as if the firearm is dislodged therefrom during transport, such that the portion of the firearm outside of the pocket 15 receives protection from the flexible body 12. In some embodiments, the pair of pockets 15 are disposed along the flexible body 12 such that the open proximal end 16 of one of the pair of pockets 15 is disposed adjacent to the first end 13, while the open proximal end 16 of the remaining pocket is disposed adjacent to the second end 14. In this manner, the user can store firearms within the pair of pockets 15 in opposing directions, such that the stock of a first firearm rests adjacent to a barrel of a second firearm, thereby allowing a user to store the firearms without overlapping to reduce the form factor of the firearm utility case 11.

In the illustrated embodiment, the flexible body 12 further comprises a first side 24 opposite a second side 26, wherein each of the first and second sides 24, 26 comprise a fastener 28 thereon. The flexible body 12 is selectively movable between an open position (as shown in FIG. 1A) and a closed position (as shown in FIG. 16). In this manner, when the flexible body 12 is in a closed position, the first side 24 can be removably secured to the second side 26 via the fastener 28 to keep the flexible body 12 in the closed position. In the shown embodiment, the fastener 28 comprises a zipper mechanism, however alternate fastening means, such as buckles, snaps, clasps, buttons, or the like are contemplated. When in the closed position, the pair of pockets 15 are disposed on an interior of the folded flexible body 12, such that the firearms disposed therein are provided additional protection. In some embodiments, the fastener 28 extends along the first and second ends 13, 14 in addition to the first and second sides 24, 26, such that the pair of pockets 15 are fully enclosed by the flexible body 12 when in the closed position. In this manner, there are no openings allowing access to the pair of pockets 15 when the flexible body 12 is in the closed position, so as to accommodate federal or state laws that require firearms be transported in closed containers.

In the illustrated embodiment, a plurality of apertures 18 are disposed in the first end 13 of the flexible body 12. The plurality of apertures 18 are configured to receive a hanger or hook therethrough to allow the user to support the flexible body 12 in an upright hanging position. Alternatively, the flexible body 12 can be supported via a pair of support straps 25 disposed on the second side 26 thereof as further described below. In the shown embodiment, a carrying strap 23 is disposed on the first side 24, wherein the carrying strap 23 provides a user with a grasping surface for easily transporting the flexible body 12 when in the closed position. In some embodiments, the carrying strap 23 further comprises a buckle 27 thereon, wherein the buckle 27 is configured to selectively adjust a length of the carrying strap 23. In this manner, the user can select a desired length of the carrying strap 23 to maximize comfort during transport.

Figure 2:
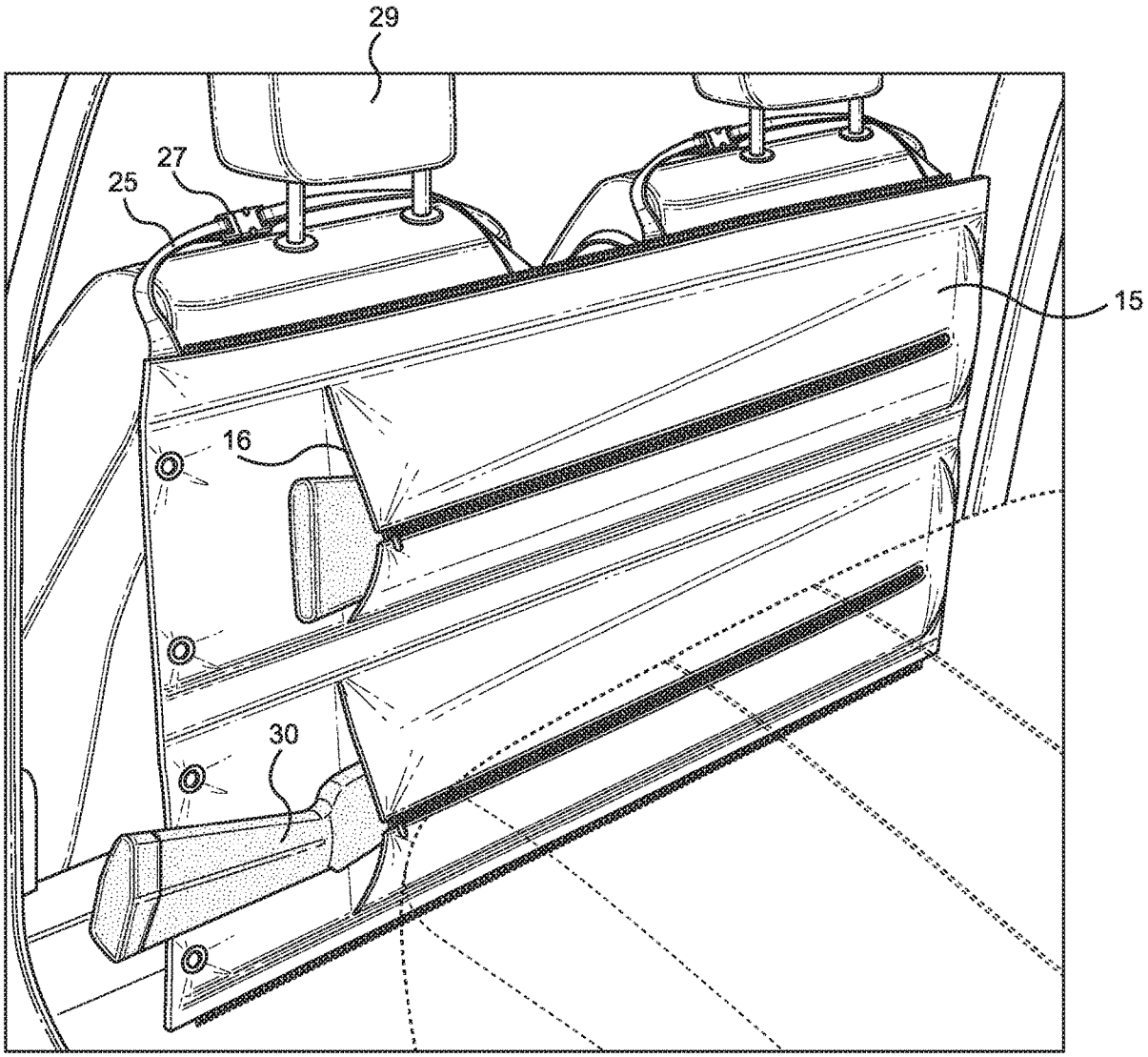
FIG. 2 shows a perspective view of an embodiment of the firearm utility case secured to vehicle seating.

Referring now to FIG. 2, there is shown a perspective view of an embodiment of the firearm utility case secured to vehicle seating. In the illustrated embodiment, the firearm utility case is secured to a rear side of vehicle seating, such that the flexible body hangs from headrests 29 of the vehicle seating via the pair of support straps 25. In this manner, the user can readily transport firearms 30 in a variety of vehicles without the need of a large trunk or other storage area. The firearms 30 are placed within the pair of pockets 15 through the open proximal end 16, such that the firearms 30 are retained therein. In the shown embodiment, the pair of support straps 25 form loops, each loop configured to be secured over the headrest 29 of a vehicle seat. Furthermore, the pair of support straps 25 as shown comprise a buckle 27 thereon, such that the user can selectively adjust the length of the pair of support straps 25. In this way, the user can adjust the size of the loops formed by the pair of support straps 25, thereby controlling a height and angle of the pair of pockets 15 relative to a vehicle floor. Additionally, by adjusting the length of the pair of support straps 25 to tightly encompass the headrest 29 of the vehicle, the user can prevent the firearms 30 from being jostled during transport.

Figure 3:
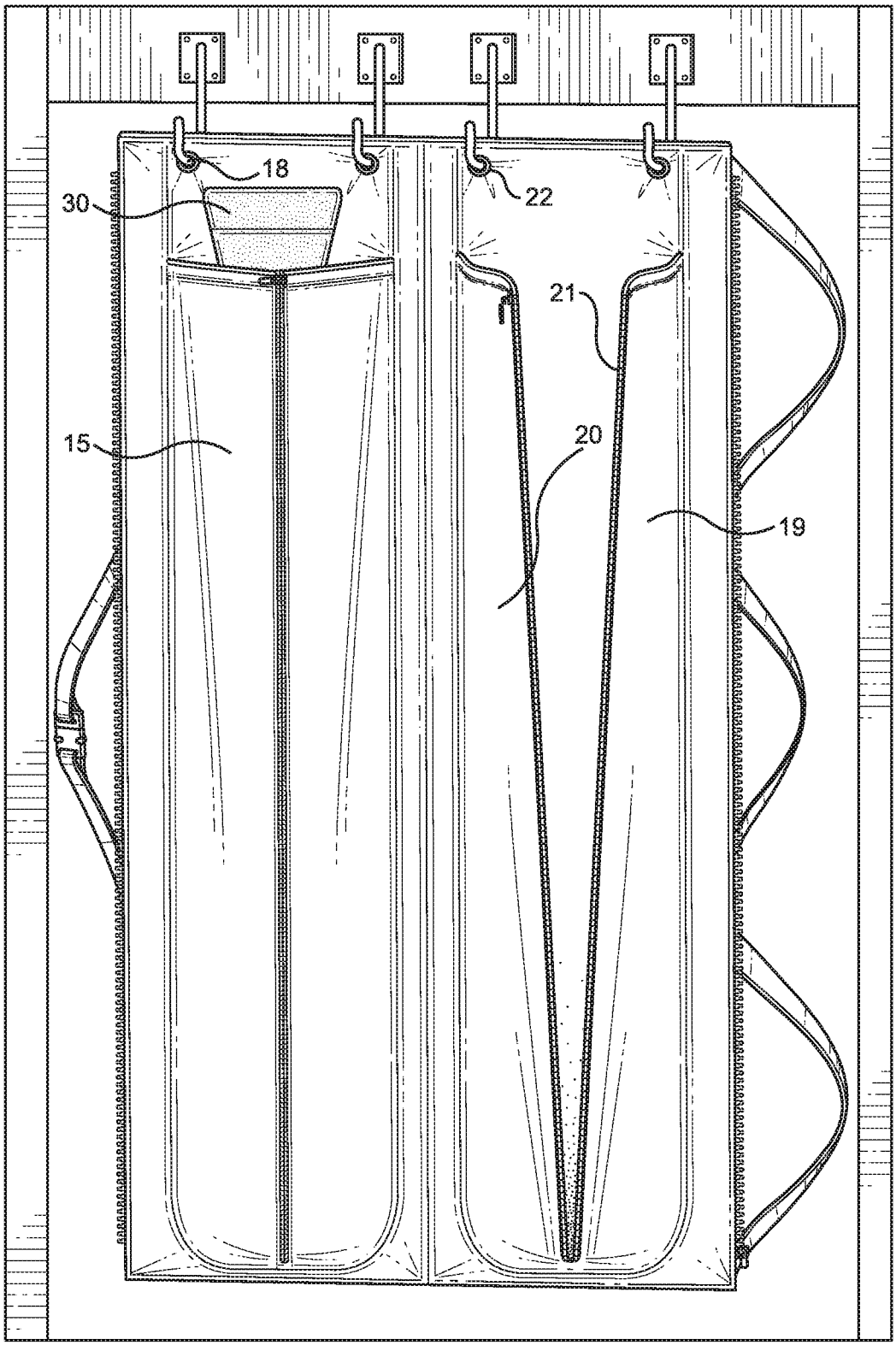
FIG. 3 shows a perspective view of an embodiment of the firearm utility case hanging from a support for storage.

Referring now to FIG. 3, there is shown a perspective view of an embodiment of the firearm utility case hanging from a support for storage. In the illustrated embodiment, the pair of pockets 15 comprise a first panel 19 removably securable to a second panel 20 via a complementary fastener 21 disposed on each of the first and second panels 19, 20. In this manner, the user can selectively open the pair of pockets 15 while the flexible body is hanging vertically to remove the firearm 30 therefrom without releasing the flexible body from the hanging supports. This allows a user to easily and efficiently remove the firearm 30 while the firearm 30 is being stored in a hanging position. In the shown embodiment, the plurality of apertures 18 further comprise a reinforcement member 22 around a perimeter thereof, such that the reinforcement member 22 provides structural stability to the plurality of apertures 18. In this manner, the plurality of apertures 18 are prevented from tearing due to prolonged hanging.

In one use, the user can secure the firearm 30 within the pair of pockets 15 via the open proximal end. When the user wishes to transport the firearm 30 from one location to another, the flexible body can be folded and secured in the closed position to protect the firearms 30 from damage caused during transport. The user can then carry the firearm utility case via the carrying strap. The firearm utility case can be placed within a vehicle for transport in the closed position, or alternatively, if vehicle storage space is limited, the flexible body can be moved to the open position and secured to the vehicle seating about the headrests via the pair of support straps. Once at the desired location, the firearm 30 can be removed from the pair of pockets 15 for use. When the user desires to store the firearm 30, the flexible body can be hung vertically from hook supports disposed through the plurality of apertures 18. The firearm utility case can be supported vertically against a wall, such as within a closet, or hung within a doorway to minimize storage space required.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm utility case, consisting of:

a flexible body having a first end opposite a second end;

wherein an entirety of each of the first end and the second end comprise a linear edge;

a pair of support straps disposed on a second side of the flexible body, wherein each support strap forms a loop;

wherein a first support strap of the pair of support straps is disposed adjacent to the first end and a second support strap of the pair of support straps is disposed adjacent to the second end;

a pair of pockets having an open proximal end and a closed distal end, the pair of pockets disposed on the flexible body extending between the first end and the second end;

wherein a first pocket of the pair of pockets is disposed on a first portion of the flexible body, and a second pocket of the pair of pockets is disposed on a second portion of the flexible body;

wherein the flexible body is selectively foldable about a midline of the flexible body wherein the midline subdivides the flexible body into the first portion and the second portion;

wherein the open position the first portion is coplanar with the second portion, and wherein the closed position the first portion is substantially parallel to the second portion;

wherein the pair of pockets are disposed parallel to each other;

a plurality of apertures disposed along the first end;

a fastener disposed on each of a first side of the flexible body and the second side of the flexible body; and wherein the fastener is configured to removably secure the first side to the second side to retain the flexible body in the closed position.

* * * * *